US011364404B2

(12) United States Patent
Hsu

(10) Patent No.: US 11,364,404 B2
(45) Date of Patent: Jun. 21, 2022

(54) MAGNETIC RESISTANCE STRUCTURE AND EXERCISE MACHINE HAVING THE SAME

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 0 days.

(21) Appl. No.: 17/038,330

(22) Filed: Sep. 30, 2020

(65) Prior Publication Data

US 2022/0096888 A1 Mar. 31, 2022

(51) Int. Cl.
*A63B 21/00* (2006.01)
*A63B 21/22* (2006.01)

(52) U.S. Cl.
CPC .. *A63B 21/00192* (2013.01); *A63B 21/00069* (2013.01); *A63B 21/225* (2013.01); *A63B 2208/0233* (2013.01)

(58) Field of Classification Search
CPC ... A63B 21/00; A63B 21/004; A63B 21/0047; A63B 21/02; A63B 21/0023; A63B 21/00054; A63B 21/00058; A63B 21/00061; A63B 21/00065; A63B 21/00072; A63B 21/00076; A63B 21/000178; A63B 21/00181; A63B 21/00185; A63B 21/00189; A63B 21/00192; A63B 21/00196; A63B 21/002; A63B 21/005; A63B 21/0055; A63B 21/0058; A63B 21/0059; A63B 21/008; A63B 21/0083; A63B 21/0087; A63B 21/0085; A63B 21/0088; A63B 21/012; A63B 21/026; A63B 21/027; A63B 21/028; A63B 21/04; A63B 21/0407; A63B 21/0414; A63B 21/0421; A63B 21/0428;

(Continued)

(56) References Cited

U.S. PATENT DOCUMENTS 5,094,447 A * 3/1992 Wang ..... A63B 22/0605 482/903
5,385,063 A * 1/1995 Wang ..... A63B 22/0056 74/108

(Continued)

FOREIGN PATENT DOCUMENTS

TW 556569 U 10/2003

*Primary Examiner* — Megan Anderson
*Assistant Examiner* — Thao N Do
(74) *Attorney, Agent, or Firm* — Rosenberg, Klein & Lee

(57) ABSTRACT

A magnetic resistance structure and an exercise machine having the same are disclosed. The magnetic resistance structure includes a seat body, a turning disc unit, a movable seat, a control unit, and a magnetic field component. The turning disc unit is pivotally connected to the seat body in an axial direction. The turning disc unit has a non-magnetic induction part extending in a radial direction. The control unit is connected with the movable seat for controlling the movable seat to approach or move away from the non-magnetic induction part. The magnetic field component includes a first component and a second component. The first component is located on the seat body. The second component is located on the movable seat. The first component and the second component selectively generate a magnetic field by changing their relative positions.

8 Claims, 9 Drawing Sheets

(58) Field of Classification Search
CPC ..... A63B 21/0435; A63B 21/0442; A63B 21/045; A63B 21/0455; A63B 21/05; A63B 21/055; A63B 21/078; A63B 21/08; A63B 21/15; A63B 21/151; A63B 21/158; A63B 21/159; A63B 21/16; A63B 21/1627; A63B 21/1681; A63B 21/22; A63B 21/222; A63B 21/225; A63B 21/227; A63B 2209/08; A63B 22/0002; A63B 22/0005; A63B 22/0007; A63B 22/001; A63B 22/0012; A63B 22/0015; A63B 22/0017; A63B 22/0046; A63B 22/0048; A63B 22/0056; A63B 22/0058; A63B 22/0061; A63B 22/140064; A63B 22/0066; A63B 22/0069; A63B 22/0084; A63B 22/0087; A63B 22/0089; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 22/04; A63B 22/06; A63B 22/0605; A63B 22/0664; A63B 22/14; A63B 22/16; A63B 22/18; A63B 22/20; A63B 22/201; A63B 22/203; A63B 22/205; A63B 22/208; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; A63B 69/16; A63B 2069/161; A63B 2069/162; A63B 2069/163; A63B 2069/164; A63B 2069/165; A63B 2069/166; A63B 2069/167; A63B 2069/168; A63B 23/00; A63B 23/04; A63B 23/0476; A63B 23/035; A63B 23/03508; A63B 23/03516; A63B 23/03525; A63B 23/03533; A63B 23/03541; A63B 23/0355; A63B 23/03558; A63B 23/03566; A63B 23/03575; A63B 23/03583; A63B 23/03591; A63B 23/0405
USPC ..... 482/1
See application file for complete search history.

(56) References Cited

U.S. PATENT DOCUMENTS

| | | | | |
|---|---|---|---|---|
| 8,052,581 | B1 * | 11/2011 | Lohr | A63B 21/015 482/63 |
| 8,957,641 | B1 * | 2/2015 | Hsu | A63B 24/0087 322/4 |
| 11,058,912 | B1 * | 7/2021 | Dunefsky | A63B 22/0005 |
| 2002/0193208 | A1 * | 12/2002 | Inoue | A63B 22/0605 482/57 |
| 2003/0109362 | A1 * | 6/2003 | Lee | A63B 21/0051 482/63 |
| 2005/0009672 | A1 * | 1/2005 | Yeh | A63B 21/153 482/114 |
| 2006/0160669 | A1 * | 7/2006 | Lizarralde | A63B 21/0051 482/63 |
| 2006/0223679 | A1 * | 10/2006 | Gerschefske | A63B 22/001 482/52 |
| 2007/0296313 | A1 * | 12/2007 | Wang | A63B 22/0605 310/67 A |
| 2012/0283068 | A1 * | 11/2012 | Lin | A63B 21/225 482/2 |
| 2013/0244838 | A1 * | 9/2013 | Jheng | A63B 22/04 482/52 |
| 2018/0102695 | A1 * | 4/2018 | Lee | H02K 24/00 |
| 2019/0209887 | A1 * | 7/2019 | Yang | A63B 21/0051 |
| 2019/0262651 | A1 * | 8/2019 | Huang | A63B 21/015 |
| 2020/0306580 | A1 * | 10/2020 | Wang | A63B 21/00076 |
| 2020/0376317 | A1 * | 12/2020 | Gibson | A63B 21/015 |

* cited by examiner

MAGNETIC RESISTANCE STRUCTURE AND EXERCISE MACHINE HAVING THE SAME

FIELD OF THE INVENTION

The present invention relates to a magnetic resistance structure and an exercise machine having the same, and more particularly to a structure that uses a variable magnetic field to control the resistance of a turning disc unit when it rotates.

BACKGROUND OF THE INVENTION

Taiwan Patent Publication No. 556569 discloses an electromagnetic resistance structure of an exercise machine, comprising a fixed frame fixed on the exercise machine, a flywheel pivoted to the fixed frame, a magnetic resistance brake ring fixed to the periphery of the flywheel, and a magnetic body fixed in the fixed frame and corresponding to the radial direction of the flywheel. The magnetic body includes a magnetic pole magnetic circuit. The magnetic pole magnetic circuit includes at least two magnetic poles. Each magnetic pole is wound with a multi-turn exciting coil. The winding direction of the multi-turn exciting coil is the same. The multi-turn exciting coil is energized to generate a magnetic field for acting on the magnetic resistance brake ring and the flywheel.

The aforementioned Publication No. 556569 uses electric current to generate a magnetic force, and the magnetic force forms a magnetic resistance to the flywheel. But, because the material of the exciting coil has resistance, there will be losses in the process of generating magnetic force by the current.

SUMMARY OF THE INVENTION

According to one aspect of the present invention, a magnetic resistance structure is provided. The magnetic resistance structure comprises a seat body, a turning disc unit, a movable seat, a control unit, and a magnetic field component. The turning disc unit is pivotally connected to the seat body in an axial direction. The turning disc unit has a non-magnetic induction part extending in a radial direction. The control unit is connected to the movable seat for controlling the movable seat to approach or move away from the non-magnetic induction part. The magnetic field component includes a first component and a second component. The first component is located on the seat body. The second component is located on the movable seat. The first component and the second component selectively generate a magnetic field by changing their relative positions. When the movable seat moves toward the turning disc unit, the first component and the second component are located on two sides of the non-magnetic induction part in the axial direction, and the magnetic field generates a resistance to the non-magnetic induction part. When the movable seat moves away from the turning disc unit, the second component and the first component are staggered in the axial direction, the magnetic field decreases or disappears, and the resistance to the non-magnetic induction part decreases or loses.

According to another aspect of the present invention, an exercise machine having the aforesaid magnetic resistance structure is provided. The exercise machine comprises an exercise machine body and a transmission unit. The magnetic resistance structure is arranged on the exercise machine body. The transmission unit is connected to the turning disc unit. When the transmission unit is applied with a force to drive the turning disc unit, the control unit controls the movable seat to change its position so that the resistance of the turning disc unit is changed.

Preferably, the first component is a permanent magnet, and the second component is a magnetic induction component. The second component is integrally formed with the movable seat. The permanent magnet is plural and arranged in an arc shape along a rotation axis of the non-magnetic induction part.

Alternatively, the first component is a magnetic induction component, and the second component is a permanent magnet. The permanent magnet is plural and arranged in an arc shape along a rotation axis of the non-magnetic induction part.

Alternatively, each of the first component and the second component is a permanent magnet. The permanent magnet is plural and arranged in an arc shape along a rotation axis of the non-magnetic induction part. The movable seat includes two side portions and a connecting portion. The two side portions are integrally connected to the connecting portion. The two side portions each have an arc-shaped front edge.

Preferably, the control unit includes a motor, two guide rods, and a drive rod. The motor is connected with the drive rod. The drive rod is connected with the movable seat. The two guide rods are connected with the seat body. The movable seat is controlled by the motor to move toward or away from the turning disc unit along the radial direction.

Preferably, the turning disc unit includes a flywheel. The non-magnetic induction part is a non-magnetic induction disc. The flywheel and the non-magnetic induction disc are coaxially pivoted to the seat body in the axial direction. The non-magnetic induction disc has a diameter greater than that of the flywheel. The first component and the second component are selectively located on two sides of the non-magnetic induction disc without contacting the flywheel.

Preferably, the turning disc unit is coaxially arranged with a transmission member and rotated synchronously. The transmission member is one of a pulley, a gear, a friction wheel and a connecting rod unit. The force is transmitted to the turning disc unit through the transmission member.

The present invention has the following effects:

1. The present invention uses the control unit to control the second component on the movable seat and the first component on the seat body to face or stagger each other in the axial direction. By controlling the positions that are staggered from each other, the magnetic field is selectively generated and the magnitude of the magnetic field is changed. The magnetic field further generates a resistance to the non-magnetic induction part.

2. The present invention does not use current to generate a magnetic force through an exciting coil, and there will be no loss in the process of generating magnetic force by the current.

3. One of the first component and the second component of the magnetic field component of the present invention is a permanent magnet, and the other is a permanent magnet or a magnetic induction component. Thereby, a magnetic field is generated between the first component and the second component, so that the non-magnetic induction part generates resistance through the magnetic field.

4. In the present invention, the turning disc unit includes a flywheel and a non-magnetic induction disc that are concentrically arranged. The diameter of the non-magnetic induction disc is greater than the diameter of the flywheel, so that the first component and the second component are located on both sides of the non-magnetic induction disc in the axial direction without contacting the flywheel, so as to achieve the effect of generating resistance to the turning disc unit. The side of the movable seat has an arc-shaped front edge, which can be closer to the flywheel without contacting the flywheel. With the permanent magnets arranged in an arc shape, the resistance to the non-magnetic induction part can be increased.

DESCRIPTION OF THE PREFERRED EMBODIMENTS

Embodiments of the present invention will now be described, by way of example only, with reference to the accompanying drawings.

Figure 1:
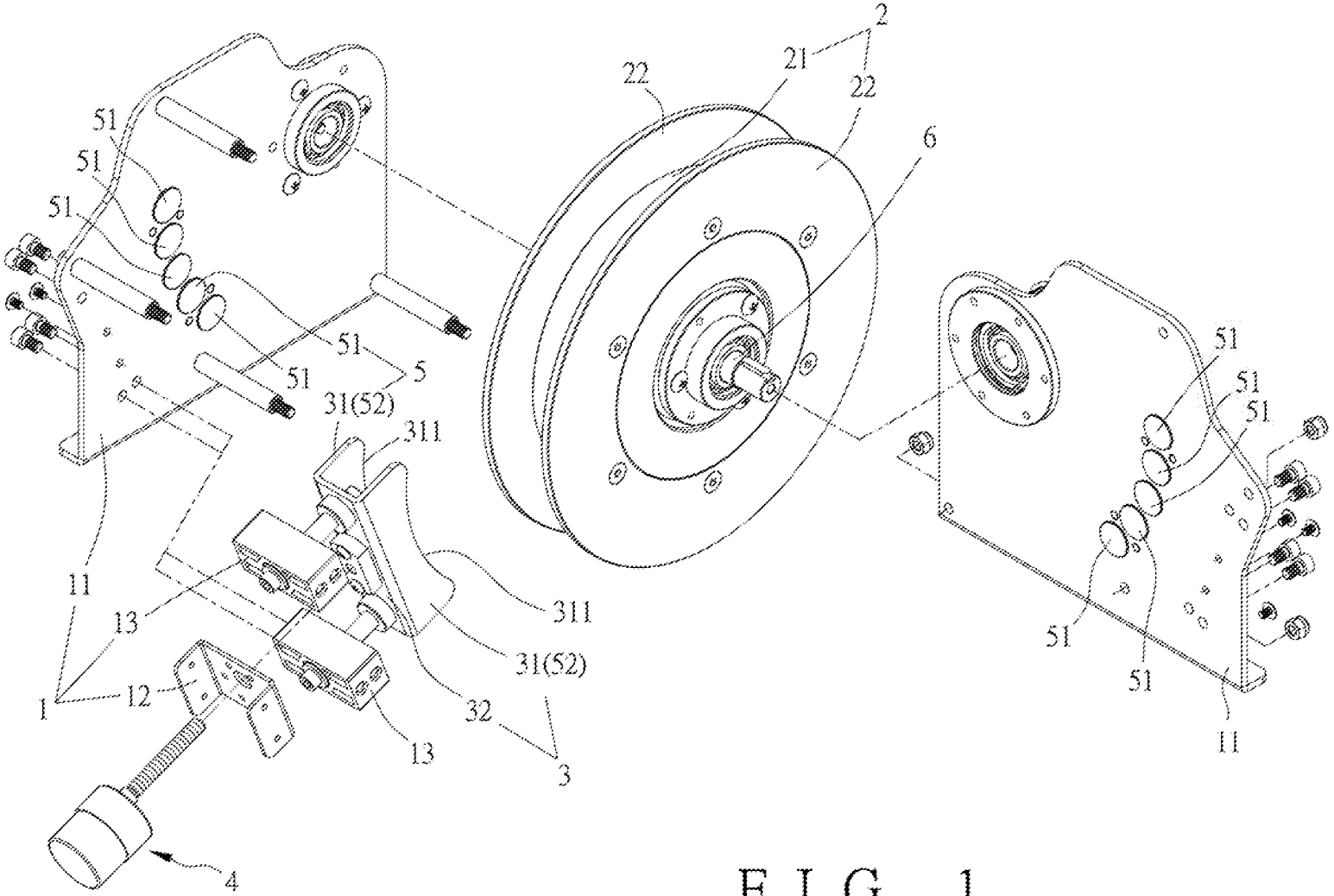
FIG. 1 is an exploded view of a first embodiment of the magnetic resistance structure of the present invention.
Figure 2:
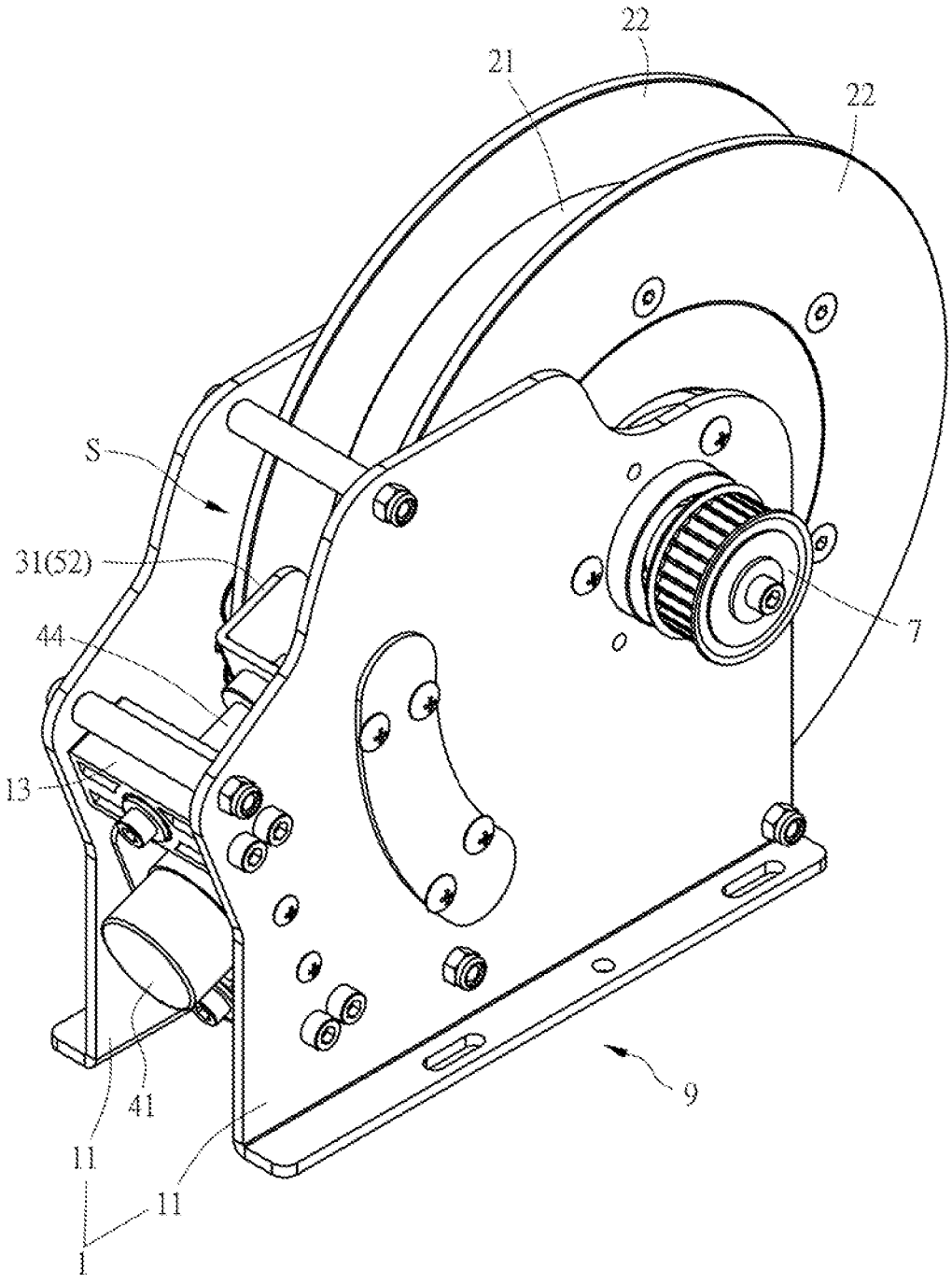
FIG. 2 is a perspective view of the first embodiment of the magnetic resistance structure of the present invention.
Figure 3:
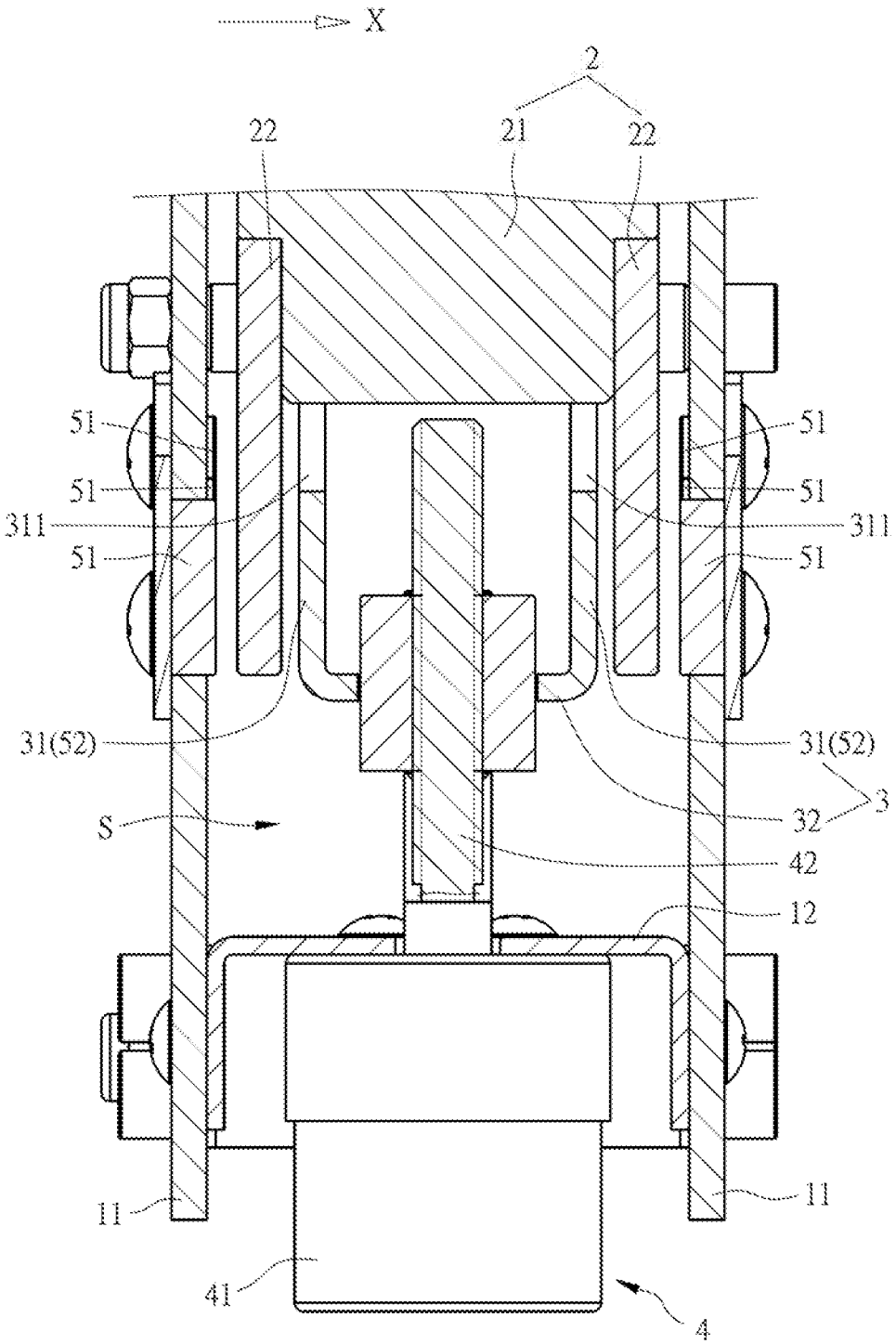
FIG. 3 is a cross-sectional view of the first embodiment of the magnetic resistance structure of the present invention.

As shown in FIG. 1 through FIG. 3, a first embodiment of a magnetic resistance structure 9 of the present invention comprises a seat body 1, a turning disc unit 2, a movable seat 3, a control unit 4, a magnetic field component 5, a rotating shaft 6, and a transmission member 7. The seat body 1 includes two corresponding side plates 11, a connecting plate 12, and two guide rod holders 13. Both sides of the connecting plate 12 and the two guide rod holders 13 are locked to the side plates 11 by screws, respectively. The guide rod holders 13 are arranged above and below the connecting plate 12, respectively. An accommodation space S is defined between the two side plates 11. The turning disc unit 2 includes a flywheel 21 and two non-magnetic induction discs 22. The flywheel 21 is arranged between the two non-magnetic induction discs 22. The two non-magnetic induction discs 22 are made of a non-magnetic induction material. In this embodiment, they are metal aluminum discs. The flywheel 21 and the two non-magnetic induction discs 22 are fixed to each other and then connected to the rotating shaft 6. The rotating shaft 6 is pivotally connected to the two side plates 11 along an axial direction X, so that the rotating shaft 6, the flywheel 21 and the two non-magnetic induction discs 22 are synchronously pivoted on the seat body 1. The diameter of the non-magnetic induction discs 22 is greater than the diameter of the flywheel 21, so that the non-magnetic induction discs 22 radially extend out of the flywheel 21. The movable seat 3 includes two side portions 31 and a connecting portion 32. The two side portions 31 and the connecting portion 32 are integrally formed. The two side portions 31 each have an arc-shaped front edge 311. Some components of the control unit 4 are fixed on the connecting plate 12, and some components of the control unit 4 are also connected to the connecting portion 32 of the movable seat 3. The magnetic field component 5 includes a first component 51 and a second component 52. In this embodiment, the first component 51 is ten permanent magnets, and the second component 52 is a magnetic induction component, such as iron. The first component 51 is fixed on the two side plates 11. Each side plate 11 is provided with five permanent magnets of the first component 51. The five permanent magnets of the first component 51 on each side plate 11 are arranged in an arc shape along the rotation axis of the non-magnetic induction disc 22. In this embodiment, the second component 52 is the two side portions 31 of the movable seat 3. The transmission member 7 is fixed on the rotating shaft 6. In this embodiment, the transmission member 7 is a pulley.

Figure 4:
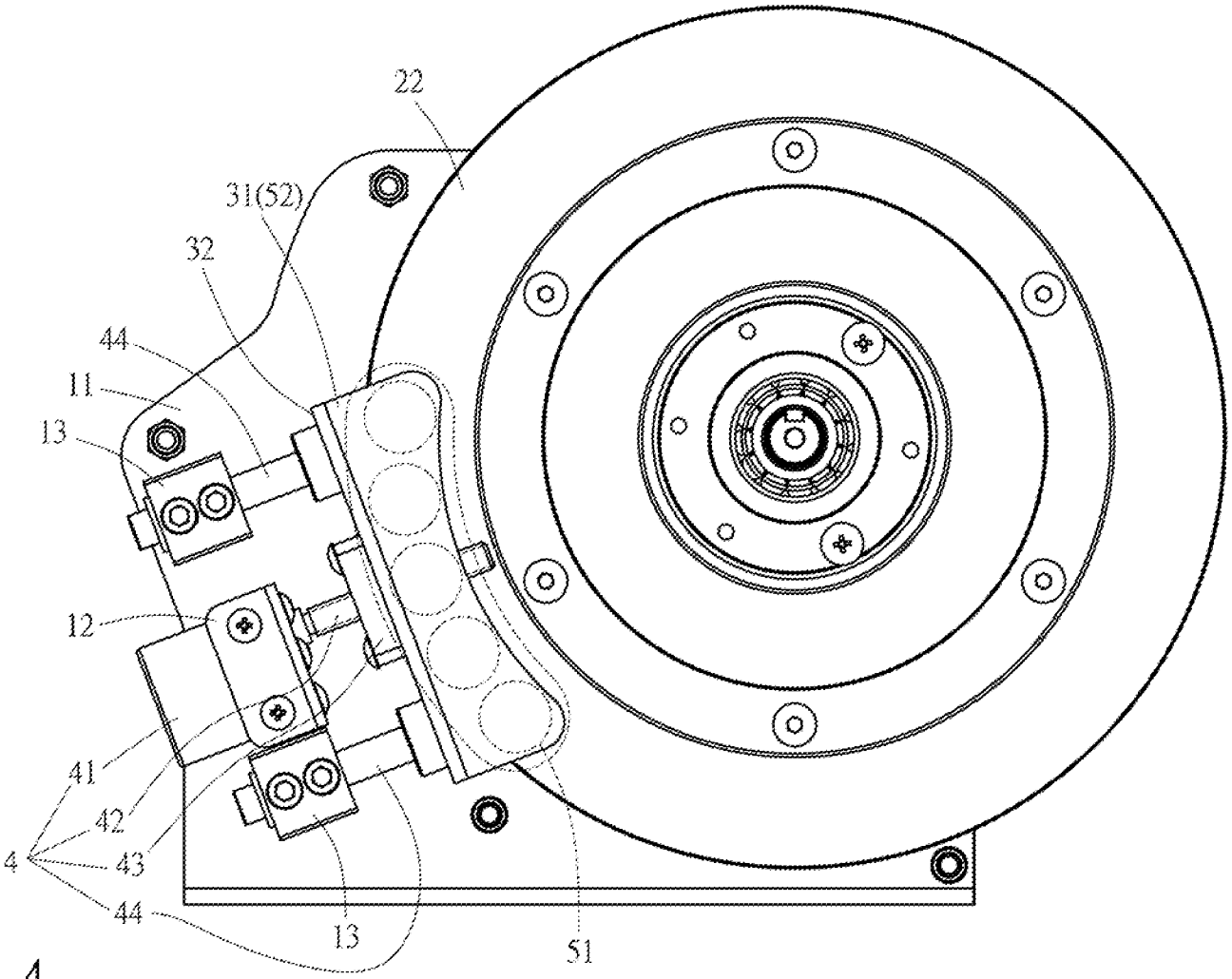
FIG. 4 is a side view of the first embodiment of the magnetic resistance structure of the present invention.

Referring to FIG. 1, FIG. 2 and FIG. 4, the control unit 4 includes a motor 41, a drive rod 42, a threaded seat 43, and two guide rods 44. The motor 41 is fixed on the connecting plate 12. The motor 41 is connected with the drive rod 42. The threaded seat 43 is fixed to the connecting portion 32 of the movable seat 3. In this embodiment, the drive rod 42 is a threaded rod. The drive rod 42 is screwed to the threaded seat 43. The two guide rods 44 are located above and below the motor 41, respectively. The two guide rods 44 and the drive rod 42 are parallel to each other. The two guide rods 44 are fixed to the connecting portion 32. The two guide rods 44 are inserted through the guide rod holders 13. The guide rod holders 13 are fixed between the two side plates 11. When the movable seat 3 is driven, the two guide rods 44 are displaced on the guide rod holders 13, so that the movable seat 3 can maintain the directional movement. In addition to the above-mentioned driving manner by the motor 41, the motor 41 of the control unit 4 of the present invention may be changed to a cable and a return spring. The cable and the return spring are connected with the movable seat 3. The movable seat 3 is pulled by the cable to move the movable seat 3. When the movable seat 3 moves, the return spring is stretched. When the cable is released, the return spring returns the movable seat 3, that is, the cable and the return spring can also control the movement of the movable seat 3. This is also a feasible embodiment of the present invention.

Please refer to FIG. 3 and FIG. 4, the drive rod 42 is driven by the motor 41 to rotate, and then the drive rod 42 drives the movable seat 3 to move. As shown in FIG. 3, when the movable seat 3 moves closer to the flywheel 21, the first component 51 and the second component 52 are located on opposite sides of the non-magnetic induction discs 22 in the axial direction X. A magnetic field is generated between the first component 51 and the second component 52, so that the non-magnetic induction discs 22 generate a resistance when passing through the magnetic field.

Figure 5:
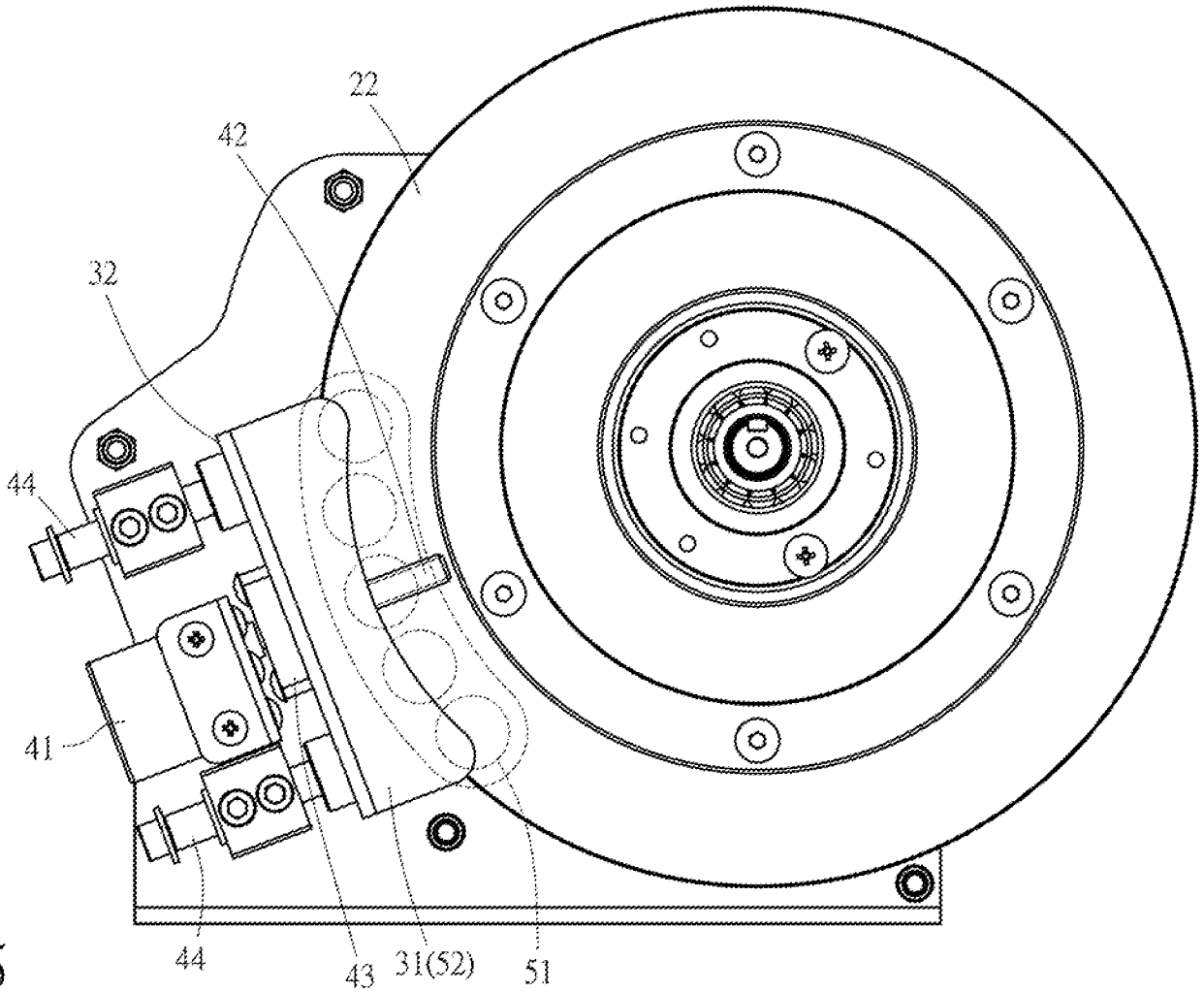
FIG. 5 is a schematic view of the second component moving away from the non-magnetic induction part of the first embodiment of the magnetic resistance structure of the present invention.

Please refer to FIG. 3 and FIG. 5. If the user wants to adjust the resistance, the drive rod 42 is driven by the motor 41 to rotate in the reverse direction, so that the threaded seat 43 drives the movable seat 3 to move away from the non-magnetic induction discs 22. At this time, only part of the second component 52 corresponds to the first component 51 in the axial direction X shown in FIG. 3, that is, the second component 52 and the first component 51 are staggered each other to weaken the strength of the magnetic field, and the non-magnetic induction discs 22 have a small resistance when passing through the magnetic field. The motor 41 is controlled by the control unit 4 to move the movable seat 3 closer to or away from the non-magnetic induction discs 22, so as to adjust the staggered distance between the second component 52 and the first component 51. In the state shown in FIG. 3, the movable seat 3 moves closer to the non-magnetic induction discs 22, and the resistance is relatively large; in the state shown in FIG. 5, the movable seat 3 moves away from the non-magnetic induction discs 22, and the resistance is relatively small.

Figure 6:
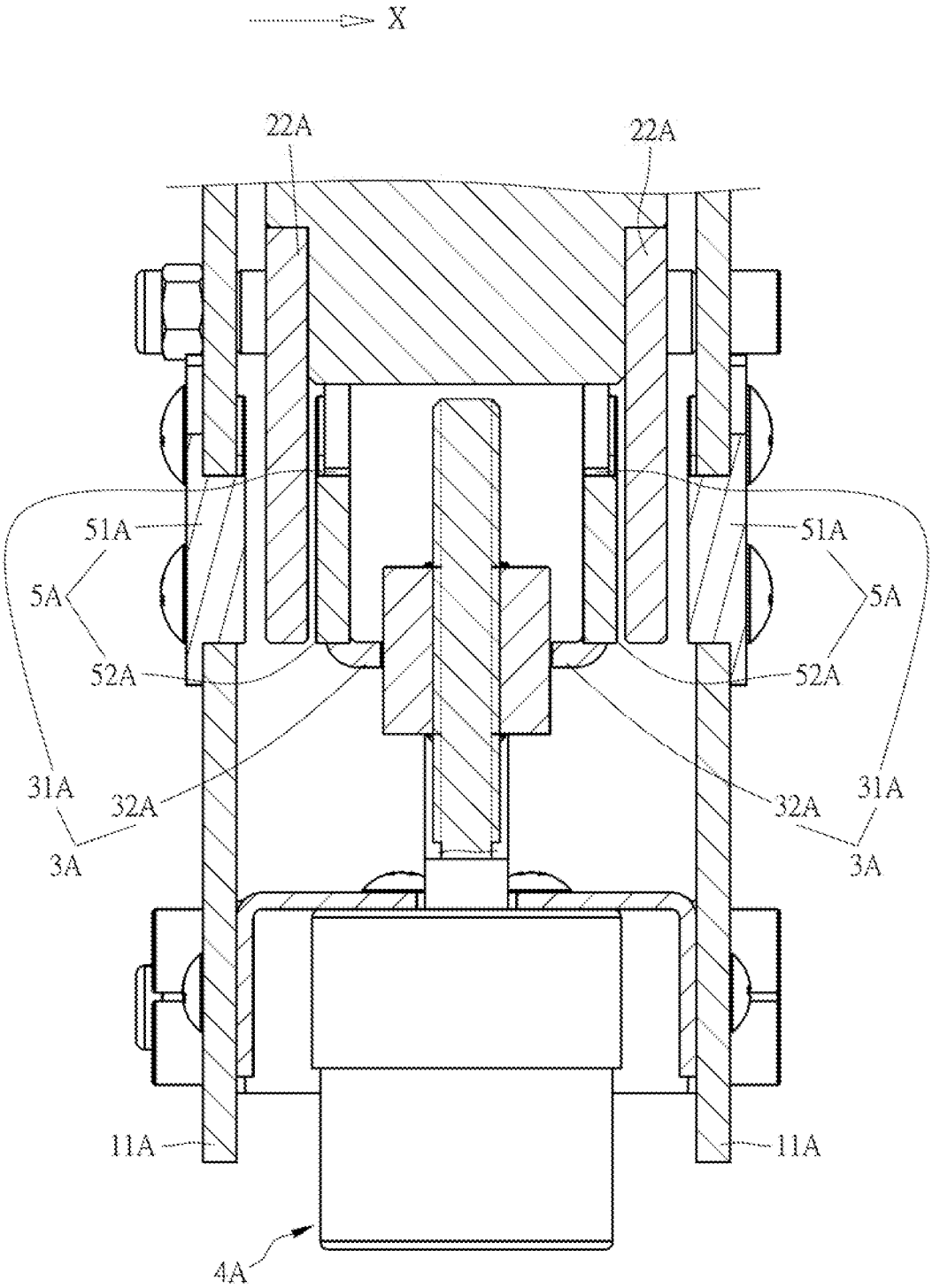
FIG. 6 is a cross-sectional view of a second first embodiment of the magnetic resistance structure of the present invention, wherein the first component is a magnetic induction component and the second component is a permanent magnet.

FIG. 6 illustrates a second embodiment of the magnetic resistance structure of the present invention. The magnetic field component 5A includes two first components 51A and two second components 52A. The two first components 51A are magnetic induction components, such as iron. The two second components 52A are permanent magnets. The two first components 51A are fixed on the two side plates 11A, respectively. In this embodiment, the side plates 11A are made of a non-magnetic induction material, such as aluminum. The movable seat 3A of the magnetic resistance structure includes two side portions 31A and a connecting portion 32A. In this embodiment, the movable seat 3A is made of a non-magnetic induction material, such as aluminum. The two side portions 31A and the connecting portion 32A are integrally formed. The two second components 52A are disposed on the two side portions 31A, respectively. The second component 52A of this embodiment is ten permanent magnets. Each side portion 31A is provided with five permanent magnets of the second component 52A. The five permanent magnets of the second component 52A on the same side are arranged in an arc shape along the rotation axis of the non-magnetic induction part. The first components 51A and the second components 52A are located on two opposite sides of the non-magnetic induction discs 22A in the axial direction X. The operation of the second embodiment is the same as that of the first embodiment, and will not be repeated hereinafter.

Figure 7:
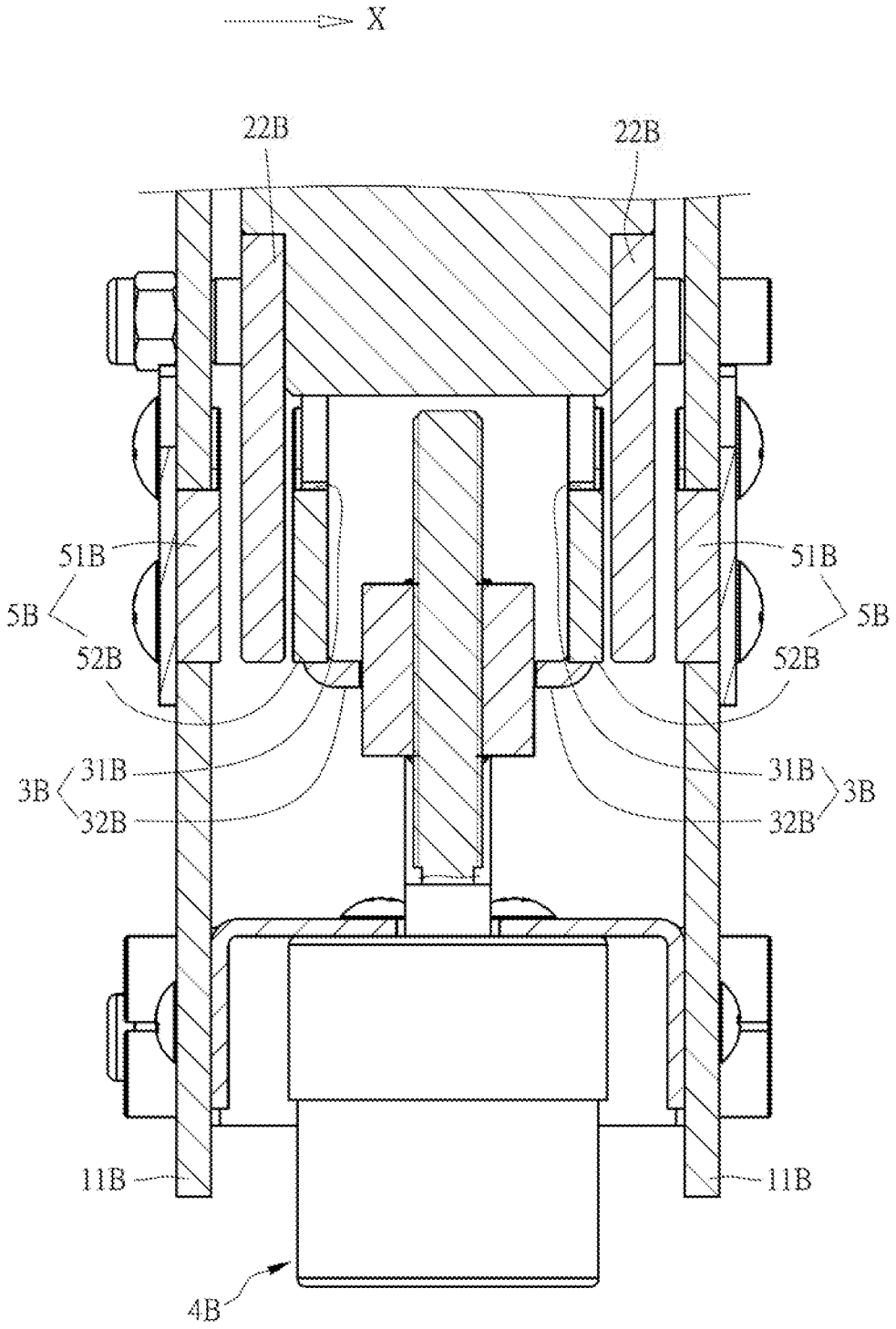
FIG. 7 is a cross-sectional view of a third embodiment of the magnetic resistance structure of the present invention, wherein both the first component and the second component are permanent magnets.

FIG. 7 illustrates a third embodiment of the magnetic resistance structure of the present invention. The magnetic field component 5B includes two first components 51B and two second components 52B. The two first components 51B and the two second components 52B are permanent magnets. The two first components 51B are fixed on the two side plates 11B, respectively. Each side plate 11B is provided with five permanent magnets of the first component 51B. The five permanent magnets of the first component 51B are arranged in an arc shape along the rotation axis of the non-magnetic induction disc 22B. In this embodiment, the side plate 11B is made of a non-magnetic induction material, such as aluminum. The movable seat 3B includes two side portions 31B and a connecting portion 32B. In this embodiment, the movable seat 3B is made of a non-magnetic induction material, such as aluminum. The two side portions 31B and the connecting portion 32B are integrally formed. The two second components 52B are disposed on the two side portions 31B, respectively. Each side portion 31B is provided with five permanent magnets of the second component 52B. The five permanent magnets of the second component 52B are arranged in an arc shape along the rotation axis of the non-magnetic induction disc 22B. The first components 51B and the second components 52B are located on two opposite sides of the non-magnetic induction discs 22B in the axial direction X. The operation of the third embodiment is the same as that of the first embodiment, and will not be repeated hereinafter.

Figure 8:
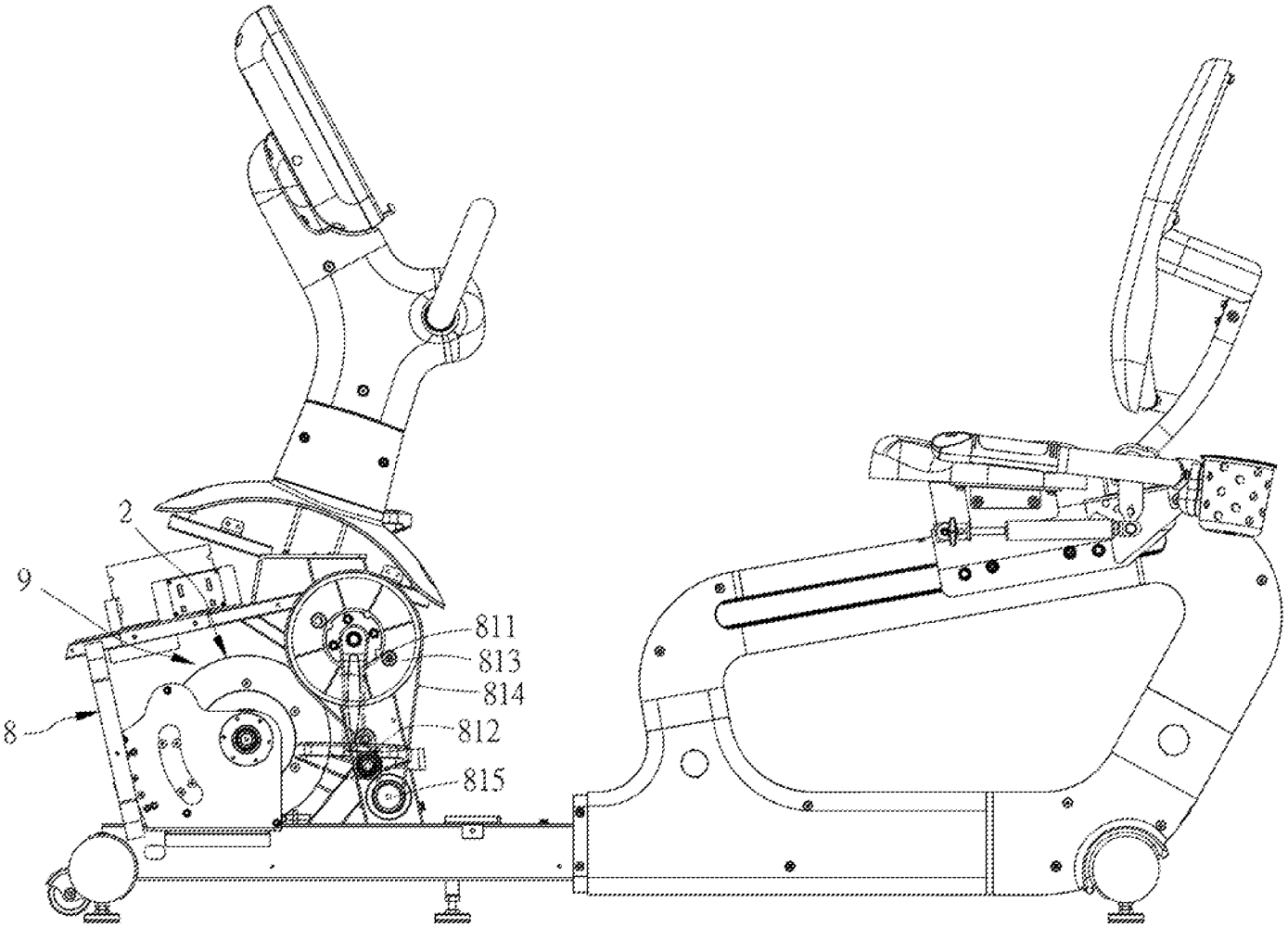
FIG. 8 is a side view of the exercise machine having the magnetic resistance structure of the present invention.
Figure 9:
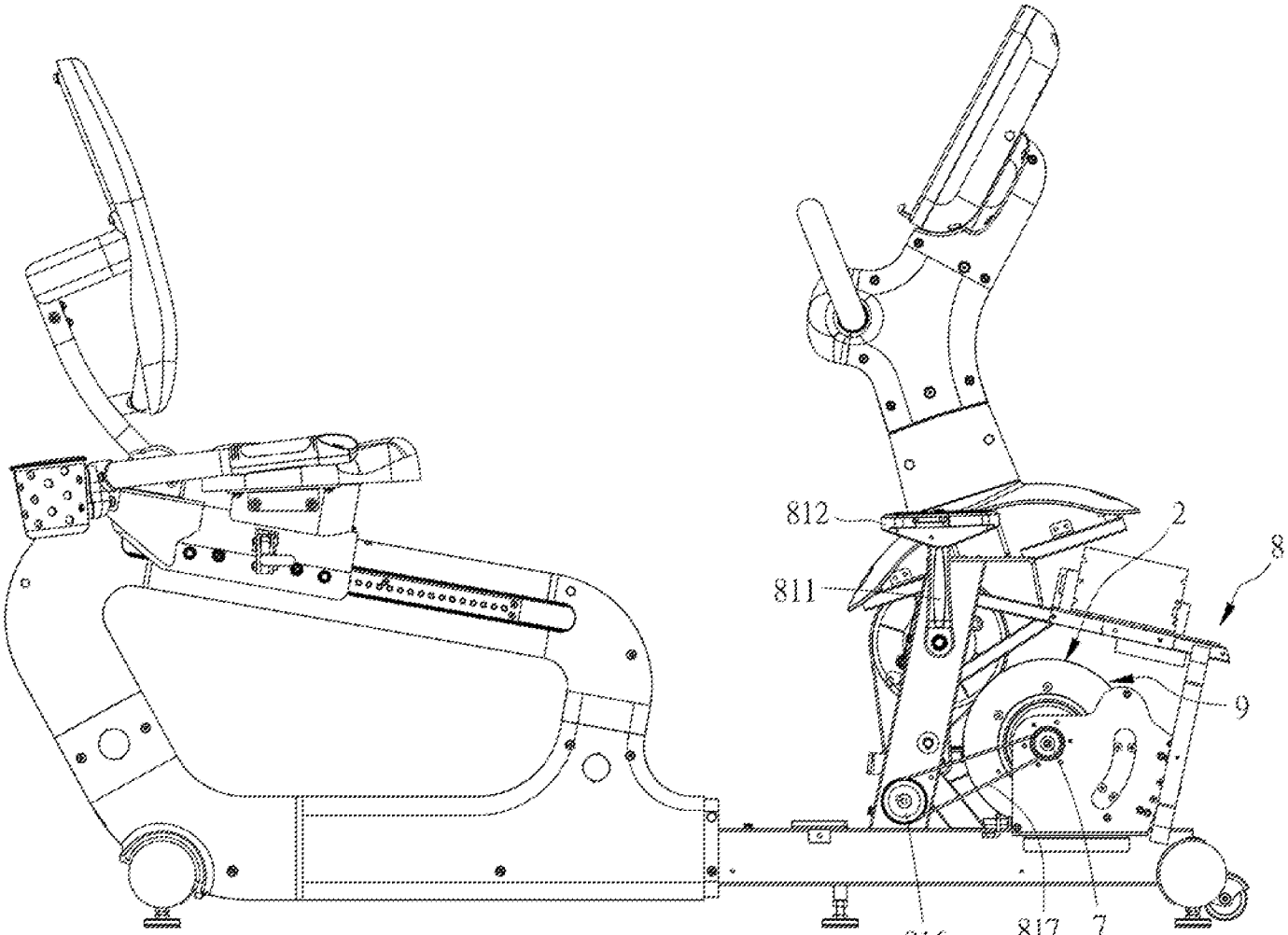
FIG. 9 is another side view of the exercise machine having the magnetic resistance structure of the present invention.

Please refer to FIG. 1, FIG. 8 and FIG. 9. Taking the first embodiment as an example, the magnetic resistance structure 9 is disposed on an exercise machine body 8. The exercise machine body 8 includes a transmission unit 81. The transmission unit 81 includes a crank 811, a pedal 812, a pulley 813, a first belt 814, a first transmission wheel 815, a second transmission wheel 816, and a second belt 817. One end of the crank 811 is connected to the pedal 812, and the other end of the crank 811 is coaxially fixed with the pulley 813. The first belt 814 connects the pulley 813 and the first transmission wheel 815. The first transmission wheel 815 and the second transmission wheel 816 are coaxially arranged on the exercise machine body 8. The second belt 817 connects the transmission member 7 of the magnetic resistance structure 9 and the second transmission wheel 816. The legs of the operator continuously step on the pedal 812 of the transmission unit 81 to rotate the pulley 813, and then the turning disc unit 2 of the magnetic resistance structure 9 is driven by the transmission of the first belt 814, the first transmission wheel 815, the second transmission wheel 816, the second belt 817 and the transmission member 7 in sequence.

Please refer to FIG. 3, FIG. 6, FIG. 7 and FIG. 8. The movable seat 3, 3A, 3B is controlled by the control unit 4, 4A, 4B described in the first, second and third embodiments to actuate the movable seat 3, 3A, 3B in the aforementioned manner to adjust the resistance of the exercise machine body 8 in operation.

In the foregoing embodiments, the number of non-magnetic induction discs 22, 22A, 22B is not limited to two. In different embodiments, there may be one or more non-magnetic induction discs 22, 22A, 22B of the present creation. In implementation, the first component 51, 51A, 51B and the second component 52, 52A, 52B are respectively staggered and located on the two sides of the non-magnetic induction discs 22, 22A, 22B, which are all feasible embodiments of the present invention. In addition, the movable seat 3, 3A, 3B of the foregoing embodiments moves in a straight line, so that the staggered distance between the first component 51, 51A, 51B and the second component 52, 52A, 52B can be adjusted. But if the movable seat 3, 3A, 3B moves in an arc around a rotating fulcrum, the staggered distance between the first component 51, 51A, 51B and the second component 52, 52A, 52B can also be adjusted, which also belongs to a feasible embodiment of the present invention. In addition, the transmission member 7 of the present invention may be in the form of a gear, a friction wheel, a connecting rod unit, etc., which also transmits the force of the operator to the turning disc unit 2.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A magnetic resistance structure, comprising:

a seat body;

a turning disc unit, pivotally connected to the seat body in an axial direction, the turning disc unit having a non-magnetic induction part extending in a radial direction;

a movable seat, corresponding to the non-magnetic induction part;

a control unit, connected to the movable seat, for controlling the movable seat to approach or move away from the non-magnetic induction part;

a magnetic field component, including a first component, the first component comprising one or more permanent magnets, and a second component, the second component comprising a magnetic induction material, the first component being located on the seat body, the second component being located on the movable seat, the first component and the second component selectively generating a magnetic field by changing; a position of the first component relative to a position of the second component;

wherein when the movable seat moves toward the turning disc unit, the first component and the second component are located on two sides of the non-magnetic induction part in the axial direction, and the magnetic field generates a resistance to the non-magnetic induction part; when the movable seat moves away from the turning disc unit, the second component and the first component are staggered in the axial direction, the magnetic field decreases or disappears, and the resistance to the non-magnetic induction part decreases or loses.

2. An exercise machine having the magnetic resistance structure as claim 1, comprising:

an exercise machine body, the magnetic resistance structure being arranged on the exercise machine body;

a transmission unit, connected to the turning disc unit;

wherein when the transmission unit is applied with a force to drive the turning disc unit, the control unit controls the movable seat to change the position of the movable seat so that the resistance of the turning disc unit is changed.

3. The exercise machine as claimed in claim 2, wherein the turning disc unit is coaxially arranged with a transmission member and rotated synchronously, the transmission member is one of a pulley, a gear, a friction wheel and a connecting rod unit, and the force is transmitted to the turning disc unit through the transmission member.

4. The magnetic resistance structure as claimed in claim 1, wherein the second component is integrally formed with the movable seat.

5. The magnetic resistance structure as claimed in claim 1, wherein the one or more permanent magnets arranged in an arc shape along a rotation axis of the non-magnetic induction part.

6. The magnetic resistance structure as claimed in claim 1, wherein the movable seat includes two side portions and a connecting portion, the two side portions are integrally connected to the connecting portion, and each of the two side portions have an arc-shaped front edge.

7. The magnetic resistance structure as claimed in claim 1, wherein the control unit includes a motor, two guide rods and a drive rod, the motor is connected with the drive rod, the drive rod is connected with the movable seat, the two guide rods are connected to the seat body and are parallel to each other, one of the two guide rods is located above the motor, the other of the two guide rods is located below the motor, and the movable seat is controlled by the motor to move toward or away from the turning disc unit along the radial direction.

8. The magnetic resistance structure as claimed in claim 1, wherein the turning disc unit includes a flywheel, the non-magnetic induction part is a non-magnetic induction disc, the flywheel and the non-magnetic induction disc are coaxially pivoted to the seat body in the axial direction, the non-magnetic induction disc has a diameter greater than that of the flywheel, the first component and the second component are selectively located on two sides of the non-magnetic induction disc without contacting the flywheel.

* * * * *